US007192507B2

(12) United States Patent
Begemann

(10) Patent No.: US 7,192,507 B2
(45) Date of Patent: Mar. 20, 2007

(54) MACHINE FOR PRODUCING A FIBROUS MATERIAL WEB

(75) Inventor: Ulrich Begemann, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 654 days.

(21) Appl. No.: 10/158,932

(22) Filed: Jun. 3, 2002

(65) Prior Publication Data

US 2003/0019600 A1 Jan. 30, 2003

(30) Foreign Application Priority Data

Jul. 30, 2001 (DE) ..... 101 37 095

(51) Int. Cl.
*D21G 9/00* (2006.01)

(52) U.S. Cl. ..... 162/289; 162/203; 162/204; 162/205; 162/207; 162/358.3; 162/900; 162/901; 34/114; 34/117; 34/115; 34/122

(58) Field of Classification Search ..... 162/289, 162/203, 204, 205, 207, 358.3, 900, 901; 34/114, 117, 463, 629, 115, 122
See application file for complete search history.

(56) References Cited

U.S. PATENT DOCUMENTS 5,295,311 A * 3/1994 Kotitschke et al. ..... 34/117
5,389,205 A 2/1995 Pajula et al.
5,611,893 A 3/1997 Pajula et al.
5,865,955 A 2/1999 Ilvespää et al.
6,004,430 A 12/1999 Ilvespää
6,428,655 B1 8/2002 Kerttula
6,442,865 B1 9/2002 Wolf et al.

FOREIGN PATENT DOCUMENTS

| | | |
|---|---|---|
| CA | 2314347 | 1/2001 |
| DE | 19882441 | 5/2000 |
| DE | 19935138 | 5/2000 |
| EP | 1072721 | 1/2001 |
| WO | 98/56983 | 12/1998 |
| WO | 99/64671 | 12/1999 |
| WO | 00/70144 | 11/2000 |

* cited by examiner

*Primary Examiner*—Mark Halpern
(74) *Attorney, Agent, or Firm*—Greenblum & Bernstein, P.L.C.

(57) ABSTRACT

Machine for producing a fibrous material web and process for guiding the web through the machine. The machine includes a wire section, a drying section, arranged downstream of the wire section with regard to a web travel direction, having at least one free web draw, a first and second shoe press separated in the web travel direction, and an upper felt and a lower transfer belt arranged to guide the fibrous material web through the second shoe press. The lower transfer belt is structured and arranged to transfer the fibrous material web to the drying section, and the material web is guided in a closed draw from the wire section to a first free web draw, with regard to the web travel direction, in the drying section. At least one high-performance drying device is positioned before the first free web draw.

25 Claims, 3 Drawing Sheets

MACHINE FOR PRODUCING A FIBROUS MATERIAL WEB

This application claims foreign priority for application 10137095.4 filed in Germany on 30 Jul. 2001.

CROSS-REFERENCE TO RELATED APPLICATIONS

The present application claims priority under 35 U.S.C. §119 of German Patent Application No. 101 37 095.4, filed on Jul. 30, 2001, the disclosure of which is expressly incorporated by reference herein in its entirety.

BACKGROUND OF THE INVENTION

1. Field of the Invention

The invention relates to a machine for producing a fibrous material web, in particular a paper or cardboard web.

2. Discussion of Background Information

The web is mechanically stressed in the pickup of the paper web in the press section by rolls, felts and transfer belts, and in pickup in the drying section by the first cylinders. This stress leads to a stretching of the paper web, and a break can even occur if the strain is too great. The level of the maximum permissible stress depends on the dry matter content of the web. It is known that web strength increases with an increasing dry matter content. If the paper machine speed increases, the resulting stress on the web in the pickup by rolls, felts, transfer belts, cylinders, etc., also increases. In the design of fast-running paper machines it is therefore particularly important for the dry matter contents of the web to conform to the prevailing conditions at the points of high stress. For this essential reason, machines for speeds above about 1600 m/min are virtually all equipped with so-called tandem presses. This press concept has a shoe press at least in the second press in order to obtain the necessary dry matter content in the pickup from the first cylinder.

Apart from the necessary dry matter content, a reliable web travel is also important for fast-running paper machines. This means that great importance is attached to measures for avoiding a web edge flutter, as fluttering web edges tend to lead to tearing or crease formation, particularly at high speeds.

The corresponding machine concepts hitherto known have the disadvantage that the dry matter contents which are achieved before the first free draw are too low, and a trouble-free web travel cannot be ensured. This means that, depending on the wet strength of the stock used, an economical production is not possible at speeds of over about 1700 m/min.

SUMMARY OF THE INVENTION

The present invention provides an improved concept for machines of the type mentioned at the outset which also renders possible higher machine running speeds without any problems.

According to the invention, the machine includes a tandem NipcoFlex® press featuring two shoe presses (each with extended nips), in which, an upper felt and a lower transfer belt are guided through the second, i.e., downstream, shoe press. The fibrous material web is transferred to the drying section via the transfer belt, and the fibrous material web is guided from the wire section up to the drying section in a closed draw, which includes at least one high-performance drying device positioned before a first free web draw.

Compared with the known frequently used tandem nip presses with a full roll press as the first press, the use of a tandem NipcoFlex® press leads to a higher dry matter content. Moreover, this is the only press concept to render possible a web guidance without open draws, i.e., completely supported, up into the drying section, which is a prerequisite for a trouble-free web travel. The transfer belt replaces the known customary second bottom felt. Through the use of a high-performance drying device before the first free web draw, the dry matter content is further increased, consequently the web strength necessary for higher speeds is achieved. The use of conventional steam heated cylinders can therefore be dispensed with, since their specific drying rate is too low to bring the web free of draw, i.e., free of separation, up to the necessary dry matter content. The high-performance drying device consequently serves to bring the web to the desired dry matter content, while avoiding open draws.

According to an alternative embodiment according to the invention, the machine for producing a fibrous material web, e.g., a paper or cardboard web, includes only one shoe press, which is double-felted, such that the fibrous material web is guided from the wire section to the drying section in a closed draw and is transferred to the drying section by a felt, preferably the bottom felt, running through the extended nip of the shoe press, and at least one high-performance drying device positioned before the first free web draw.

If possible, the line on which the fibrous material web is supported by only one felt of the second shoe press should be less than about 500 mm. If this condition is met, the use of a transfer belt can thus be dispensed with.

The web travel is improved in the sensitive area by both alternative solutions.

In a preferred embodiment of the machine according to the invention, the high-performance drying device includes in particular a larger backup roll with an assigned jet impingement dryer. In this manner, the fibrous material web guided over the backup roll and can be impinged with a hot-air and/or hot-steam jet impingement.

It is therefore no longer necessary to guide the still relatively damp material web over smooth contact surfaces in order to achieve an adequate heat transfer. This avoiding of smooth contact surfaces at the start of drying practically eliminates the danger of web breaks as well as an over stretching of the web edges. In particular, now higher drying rates are also possible, correspondingly shortening the total length of the drying section.

The material web is advantageously supported in the area of the jet impingement dryer assigned to the backup roll by an open, i.e., not smooth, support surface, which can be formed either by the surface or a covering or coating of the backup roll or by the surface of an endless belt or wire guided over the backup roll.

It is advantageous if the backup roll has an outside diameter in the range of approximately 2.5 to approximately 8 m and preferably in the range of approximately 3 to approximately 5 m.

In an expedient, practical embodiment, the backup roll assigned to the jet impingement dryer is suctioned. An endless wire can be guided over the backup roll here to hold the material web. The backup roll can be suctioned, e.g., directly through an interior suction box or by an exterior suction box via openings provided in the jacket surface. With increasing diameter, not only the circumference of the backup roll increases, but also the angle of wrap possibly covered by the jet impingement dryer and thus the drying surface.

The jet impingement dryer can be located above or below the cylinder level. In particular, several such jet impingement dryers are also possible. Thus, e.g., at least two such jet impingement dryers can be arranged on the same side or at least two such jet impingement dryers can be arranged on different sides of the material web.

Expediently, at least one jet impingement dryer equipped with at least one dryer hood is provided.

Otherwise the drying section of the machine according to the invention can be embodied in particular as described in German Patent Application No. DE-A-199 35 138 and counterpart U.S. patent application Ser. No. 09/621,655 filed Jul. 21, 2000, the disclosures of which are expressly incorporated by reference in their entireties in the present application.

The present invention is directed to a machine for producing a fibrous material web that includes a wire section, a drying section, arranged downstream of the wire section with regard to a web travel direction, having at least one free web draw, a first and second shoe press separated in the web travel direction, and an upper felt and a lower transfer belt arranged to guide the fibrous material web through the second shoe press. The lower transfer belt is structured and arranged to transfer the fibrous material web to the drying section, and the material web is guided in a closed draw from the wire section to a first free web draw, with regard to the web travel direction, in the drying section. At least one high-performance drying device is positioned before the first free web draw.

In accordance with a feature of the instant invention, the first and second shoe presses can include tandem extended nip presses. Further, the fibrous material web includes one of a paper or cardboard web.

According to another feature of the invention, the high-performance drying device can include comprises backup roll with an assigned jet impingement dryer arranged such that the fibrous material web is guided over the backup roll to be impinged with at least one of a hot-air and hot-steam jet impingement. Further, an open support surface may be structured and arranged to support the fibrous material web in an area of the jet impingement dryer. The open support surface is not smooth. Still further, the open support surface can be formed by one of a surface, a coating, or a covering of the backup roll or by a surface of one of an endless belt or wire guided over the backup roll. The backup roll can have an outside diameter in a range of between about 2.5–8 m, and preferably in a range of between about 3–5 m. A suction device can be coupled to the backup roll, and the suction device may be structured and arranged to form a narrow tail threading zone. The suction device can include one of an interior suction box and an exterior suction box. Further still, an additional jet impingement dryer can be included, such that the jet impingement dryers are arranged to act on a same side of the fibrous material web, or an additional jet impingement dryer can be included, such that the jet impingement dryers are arranged to act on different sides of the fibrous material web. The jet impingement dryer may include at least one dryer hood.

In accordance with the present invention, the transfer of the fibrous material web to the drying section may take place in the area of a take-up suction roll.

A straight or slightly curved guide path can be formed between a transfer point of the fibrous material web from the lower transfer belt and the high-performance drying device. The straight or slightly curved guide path may include at least one of a jet impingement drying device and a transfer foil line to dry the fibrous material web prior to the high-performance drying device.

The present invention is directed to a machine for producing a fibrous material web that includes a wire section, a drying section, arranged downstream of the wire section with regard to a web travel direction, having at least one free web draw, only one shoe press structured and arranged to include an extended nip press, and an upper felt and a lower felt arranged to guide the fibrous material web through the second shoe press. One of the upper and lower felts is structured and arranged to transfer the fibrous material web to the drying section, such that the material web is guided in a closed draw from the wire section to a first free web draw, with regard to the web travel direction, in the drying section. At least one high-performance drying device is positioned before the first free web draw.

According to a feature of the instant invention, the one of the upper and lower felts includes the lower felt. Further, the fibrous material web includes one of a paper and cardboard web.

Immediately preceding a transfer point from the one of the upper and lower felts, the fibrous material web may be supported by only the one felt for a distance shorter than about 500 mm.

The present invention is directed to a process of guiding a fibrous material web through a production machine that includes a wire section and a drying section, arranged downstream of the wire section with regard to a web travel direction, that has at least one free web draw, an upper felt and a lower belt arranged to guide the fibrous material web through at least one shoe press, and at least one high-performance drying device being positioned before a first free web draw, with regard to the web travel direction, in the drying section. The process includes guiding the fibrous material web, via the upper felt and lower belt, through the at least one shoe press, transferring the fibrous material web from the lower belt to the drying section, and guiding the fibrous material web through the at least one high-performance drying device. The fibrous material web is guided in a closed draw from the wire section to the first free web draw.

In accordance with a feature of the instant invention, the at least one shoe press includes only one shoe press and the lower belt is a lower felt, and the process may further include, immediately preceding a transfer point of the fibrous material web from the lower felt, supporting the fibrous material web only with the lower felt for a distance of less than 500 mm.

According to another feature of the invention, the at least one shoe press can include a first and a second shoe press separated from each other in the web travel direction and the lower belt can include a lower transfer belt, such that the lower transfer belt and the upper felt are arranged to guide the fibrous paper web through at least the second shoe press, which is arranged downstream of the first shoe press.

The at least one high-performance drying device may include a backup roll with an assigned jet impingement dryer, and the process can further include, in the high-performance drying device, guiding the fibrous material web over the backup roll while impinging a surface of the fibrous material web to at least one of hot-air and hot-steam jet impingement.

The machine can further include a straight or slightly curved guide path formed between a transfer point of the fibrous material web from the lower transfer belt and the high-performance drying device, and the process may further include drying the fibrous material web prior to the high-performance drying device. The drying prior to the high-performance drying device can include drying with at least one of a jet impingement drying device and a transfer foil line.

The process may also include supporting the fibrous material web as it is guided through the at least one high-performance drying device on an open support surface.

In accordance with yet another feature of the instant invention, the process may further include suctioning the fibrous material web as it is guided through the at least one high-performance drying device.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
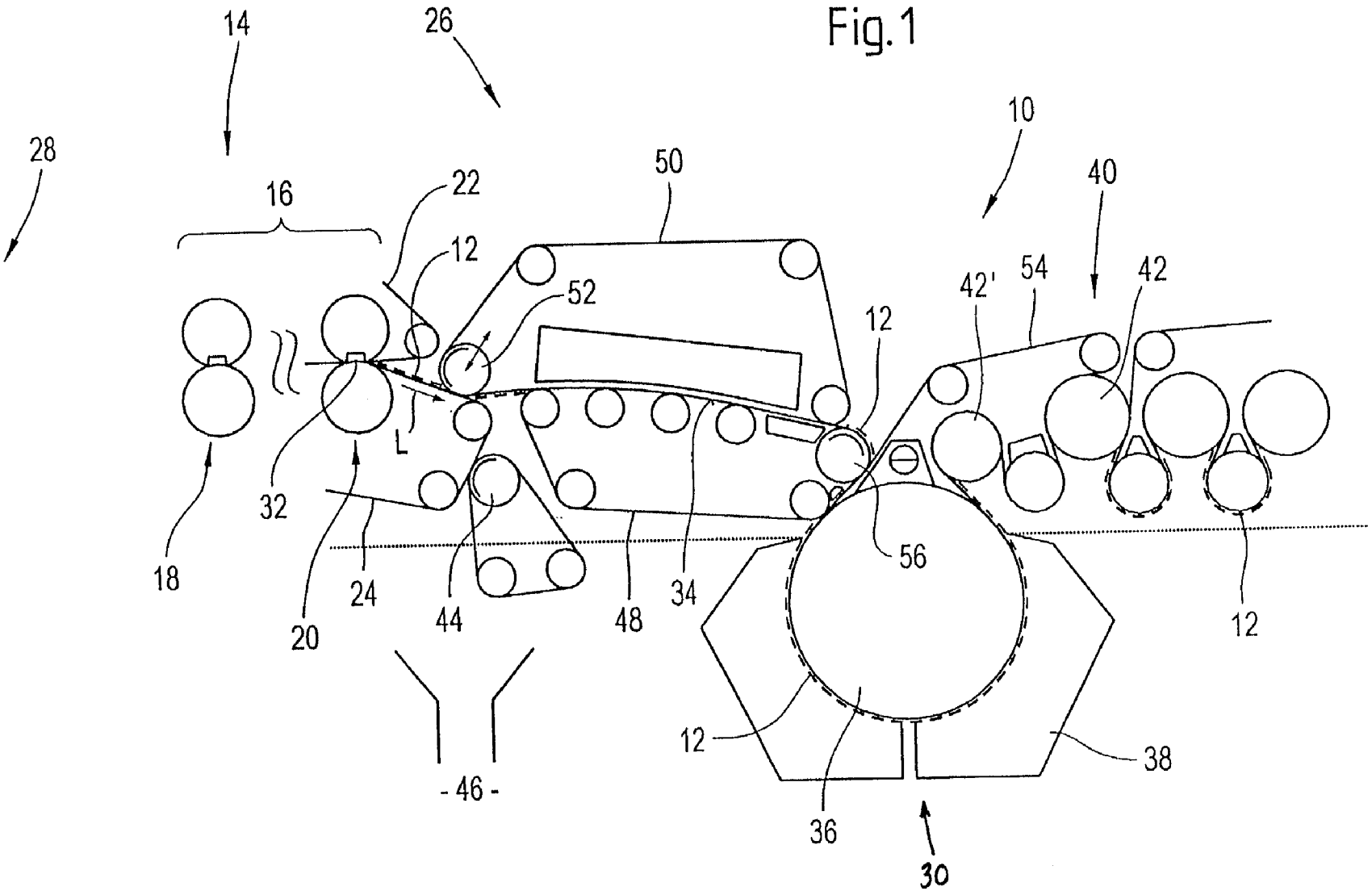
FIG. 1 illustrates a diagrammatic partial view of an exemplary embodiment of a machine for producing a fibrous material web with a tandem NipcoFlex® press.

FIG. 1 shows a diagrammatic partial view of a first embodiment of a machine 10 for producing a fibrous material web 12, which can be in particular a paper or a cardboard web.

The press section 14 of this machine 10 comprises a so-called tandem NipcoFlex® press 16 which is formed by two shoe presses 18 and 20.

An upper felt 22 and a lower transfer belt 24 are guided through second shoe press 20, which is positioned downstream from first shoe press 18 relative to a web travel direction. Fibrous material web 12 is transferred to drying section 26 of the machine 10 via transfer belt 24, such that fibrous material web 12 is guided from wire section 28 to drying section 26 in a closed draw. At least one high-performance drying device 30 is provided before a first free web draw or open web draw.

In the present exemplary embodiment, starting from the nip of second shoe press 20 of press section 14, material web 12 is guided over at least one straight or slightly curved line 34 in a closed draw to a larger backup roll 36 with an assigned jet impingement dryer 38. Material web 12 is guided over backup roll 36 to be impinged with a hot-air and/or hot-steam jet impingement. Backup roll 36 and jet impingement dryer 38 form high-performance drying device 30.

Straight or slightly curved line 34 can be formed as a jet impingement dryer- and/or as a transfer foil line.

Backup roll 36 is arranged before a drying group 40 with drying cylinders 42.

As already mentioned, a jet impingement drying is also fundamentally possible on a transfer foil line. However, such a transfer foil line can also only be provided as a transporting line.

An additional transfer belt, for instance, can also be provided to transfer material web 12 from press section 14 to the following jet impingement drying- or transfer foil line.

The result is a combination of a closed draw after press section 14, whereby a transfer belt can also be provided, a straight or slightly curved jet impingement drying- and/or transfer foil line 34 for reliable web guidance and a final jet impingement dryer 38 provided, e.g., with a hood or the like, on a larger backup roll 36, which can take over the main performance of the jet impingement drying. There is no separation of material web 12 from the smooth heating surfaces at the start of drying.

The still unstable material web 12 to be dried, can be transferred in a closed manner from press 16 and then first dried in at least one straight or slightly curved jet impingement drying- and/or transfer foil line 34 and subsequently dried by at least one, e.g., hood-like jet impingement dryer 38, without the web being removed from a heated, smooth surface, as long as it has a dry matter content of less than, e.g., approximately 55 to 65%. The diameter of a larger backup roll 36 can be, e.g., in a range of approximately 2.5 to 8 m and preferably in a range of approximately 3 to 5 m. Afterwards material web 12 can be finish-dried in a single-row or double-row drying group 42 with several drying cylinders 44. Instead of a straight or slightly curved jet impingement drying line, a transfer foil line can also be provided that serves only the web transfer to the larger backup roll.

In the present embodiment, material web 12 can be moved in the area of an additional pickup roll 44 into cellar 46, by which roll material web 12 can be removed from transfer belt 24 that is guided through second shoe press 20 of press section 14.

In the present case, at least one straight or slightly curved jet impingement drying- or transfer foil line 34 is provided, on which material web 12 is reliably guided between two wires 48 and 50. Material web 12 can thereby be impinged from the upper or lower side through relevant wire 48 or 50 with a respective jet impingement.

Fibrous material web 12 is taken over in the area of take-up suction roll 52 provided inside the loop of wire 50 from transfer belt 24.

As FIG. 1 shows, backup roll 36 assigned to jet impingement dryer 38 can be suctioned and an endless wire 54 can be guided over backup roll 36. In the present exemplary embodiment, wire 54 is also simultaneously assigned to drying group 40. However, it is also fundamentally possible to assign a separate wire to backup roll 36. Further, the relevant wire can also be simultaneously assigned, e.g., to transfer foil line 34.

The suctioning of backup roll 36 can take place, e.g., directly through an interior suction box or through an exterior suction box via openings provided in the jacket surface.

As FIG. 1 shows, wire 48 ofjet impingement drying- or transfer foil line 34 can be guided over a smaller suction roll 56 before larger backup roll 36. A part of such a smaller suction roll can be embodied as a gauge pressure zone, or a gauge pressure box is installed in the gap in order to press out material web 12 from the previous wire, here wire 48.

In this embodiment according to FIG. 1, material web 12 is thus transferred, e.g., from a wire 48 via a straight or slightly curved jet impingement drying- or transfer foil line 34 to a wire 54 guided over the following larger backup roll 36, whereby the transfer area can be suctioned by a suction box provided before or on backup roll 36. However, it is also possible, e.g., that a wire assigned to a straight or slightly curved jet impingement drying- or transfer foil line 34 is simultaneously guided over the following larger backup roll 36 and the material web is guided onto backup roll 36 in the area of a guide roll or glass roll, which ensures a good web detachment.

Fundamentally several high-performance drying devices can also be provided. Here, e.g. at least two are possible on the same side or, e.g., at least two are arranged on different sides of the jet impingement dryer assigned to material web 12.

For the rest, drying section 26 can be embodied in particular as described in the above-noted German Patent Application No. DE 199 35 138 and counterpart U.S. patent application Ser. No. 09/621,655.

In the case of a lower jet impingement dryer 38, material web 12 can be guided after larger backup roll 36 with wire 54 directly onto an unheated paper guide roll or a drying cylinder 42'.

Figure 2:
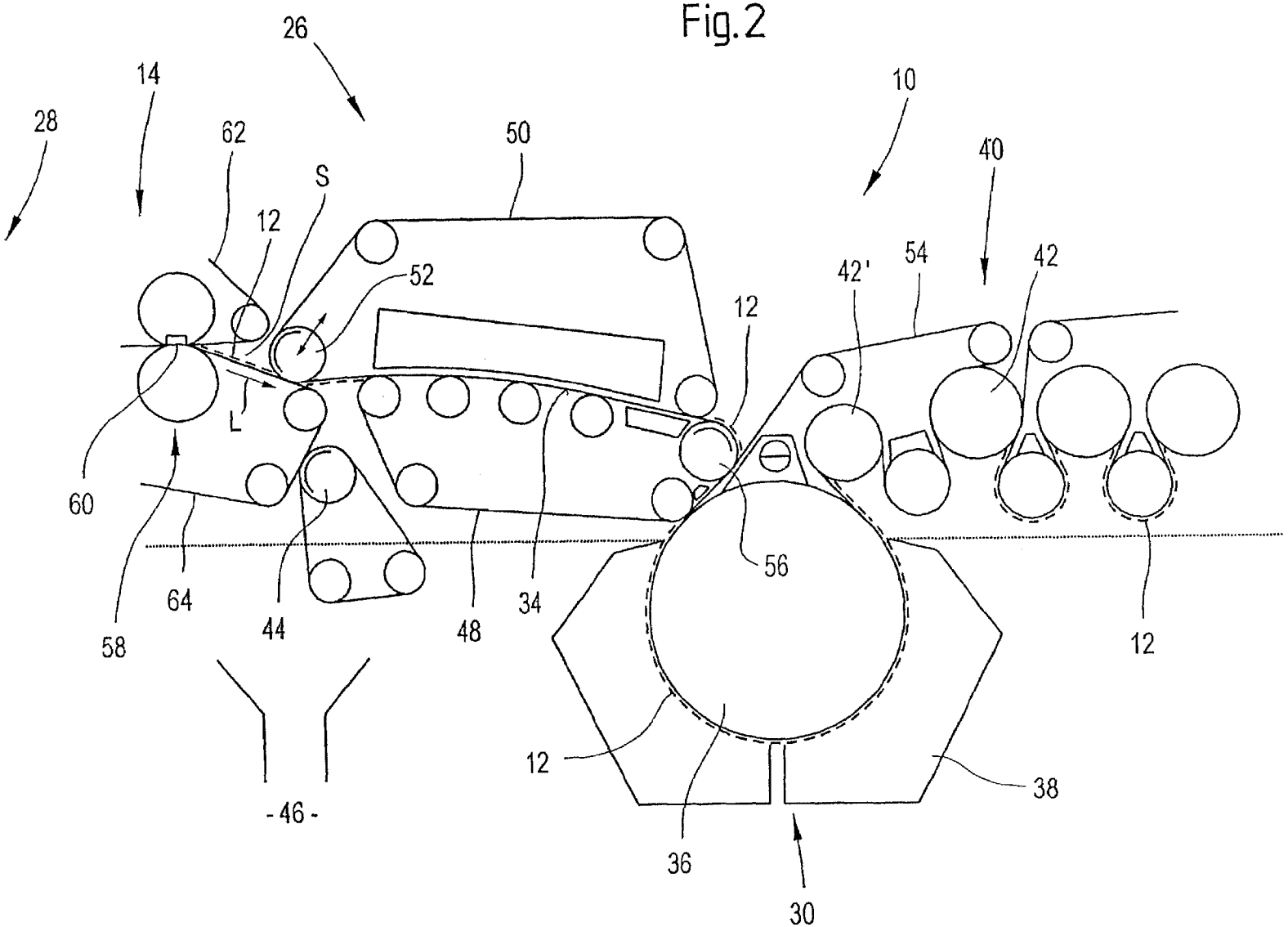
FIG. 2 illustrates a diagrammatic partial view of another embodiment of a machine for producing a fibrous material web with only one shoe press.
Figure 3:
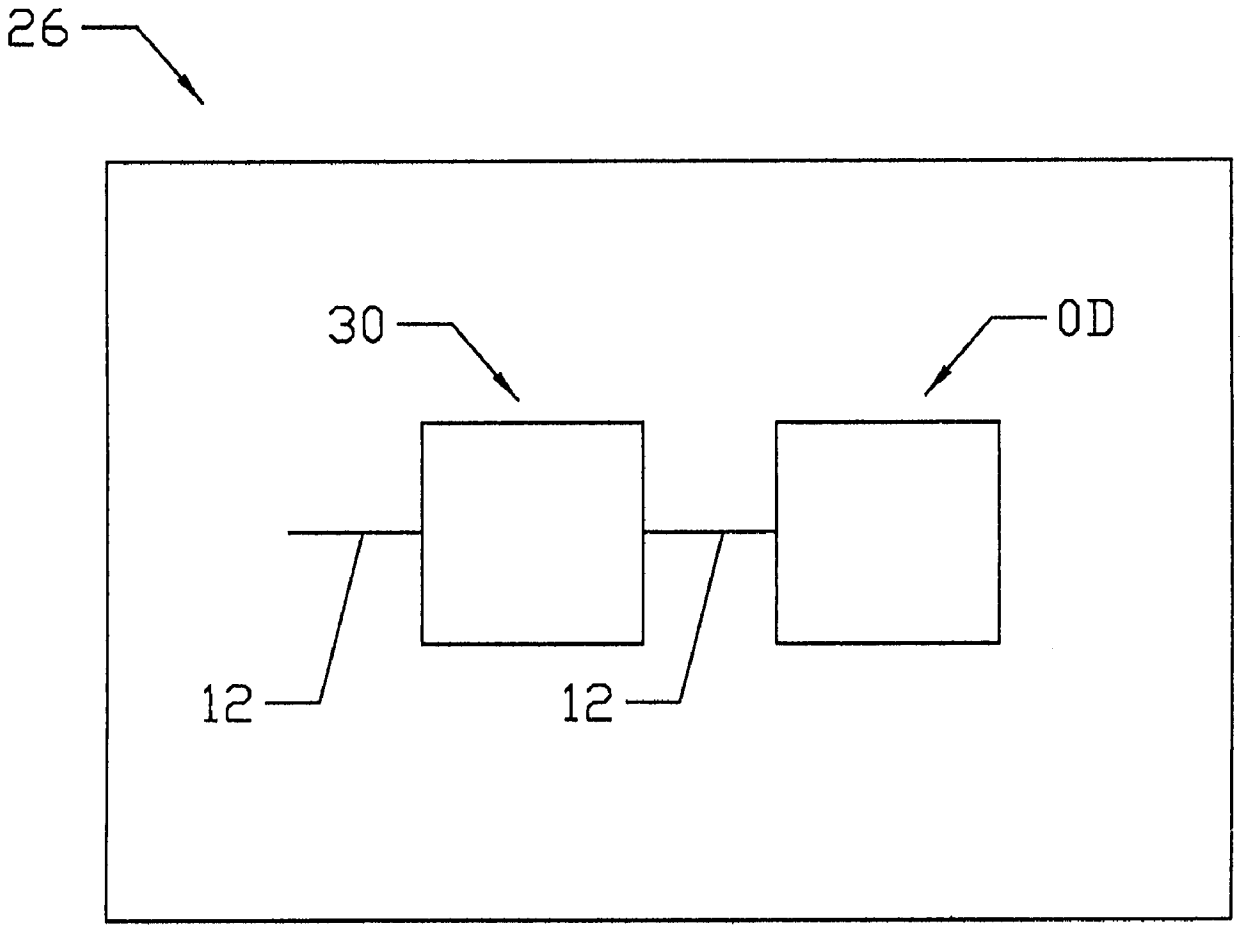
FIG. 3 schematically shows the drying section having the first open draw arranged downstream of the high-performance drying device.

FIG. 2 shows a diagrammatic partial view of another variant of a machine 10' for producing a fibrous material web 12, which again can be a paper or cardboard web.

In this case only a shoe press 58 is provided in press section 14, i.e., only a single extended nip 60 in the web travel direction. Extended nip 60 is double-felted such that an upper felt 62 and a bottom felt 64 are guided through nip 60. Fibrous material web 12 is thus taken over here in the area of suction roll 52 by bottom felt 64 in drying section 26. The line S on which fibrous material web 12 is supported only by bottom felt 64 of shoe press 58 is preferably shorter than approximately 500 mm.

For the rest, machine 10' can be embodied in particular as that in FIG. 1. Corresponding parts are assigned the same reference numbers.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

10 Machine
10' Machine
12 Fibrous material web
14 Press section
16 Tandem NipcoFlex® press
18 Shoe press
20 Shoe press
22 Upper felt
24 Transfer belt
26 Drying section
28 Wire section
30 High-performance drying device
32 Nip
34 Line
36 Backup roll
38 Jet impingement dryer
40 Drying group
42 Drying cylinder
42' Paper roll or drying cylinder
44 Pickup roll
46 Cellar
48 Wire
50 Wire
52 Take-up suction roll
54 Wire
56 Suction roll
58 Shoe press
60 Extended nip
62 Upper felt
64 Bottom felt
S Line

What is claimed:

1. A machine for producing a fibrous material web comprising:

a wire section;

a drying section, arranged downstream of said wire section with regard to a web travel direction, comprising at least one open web draw;

first and second shoe presses separated in the web travel direction each of said first and second shoe presses being an extended nip press;

an upper felt and a lower transfer belt arranged to guide the fibrous material web through said second shoe press;

said lower transfer belt being structured and arranged to transfer the fibrous material web to said drying section, wherein the material web is guided in a closed draw from said wire section to said open web draw, with regard to the web travel direction, in said drying section; and at least one high-performance drying device being positioned before said open web draw, wherein said open web draw is a first open web draw.

2. The machine in accordance with claim 1, wherein said first and second shoe presses comprise tandem extended nip presses.

3. The machine in accordance with claim 2, wherein the fibrous material web comprises one of a paper or cardboard web.

4. The machine in accordance with claim 1, wherein said high-performance drying device comprises backup roll with an assigned jet impingement dryer arranged such that the fibrous material web is guided over said backup roll to be impinged with at least one of a hot-air and hot-steam jet impingement.

5. The machine in accordance with claim 4, further comprising an open support surface structured and arranged to support the fibrous material web in an area of said jet impingement dryer.

6. The machine in accordance with claim 5, wherein said open support surface is not smooth.

7. The machine in accordance with claim 6, wherein said open support surface is formed by one of a surface, a coating, or a covering of said backup roll or by a surface of one of an endless belt or wire guided over said backup roll.

8. The machine in accordance with claim 4, wherein said backup roll has an outside diameter in a range of between about 2.5–8 m.

9. The machine in accordance with claim 8, wherein the outside diameter is in a range of between about 3–5 m.

10. The machine in accordance with claim 4, further comprising a suction device coupled to said backup roll.

11. The machine in accordance with claim 10, wherein said suction device is structured and arranged to form a narrow tail threading zone.

12. The machine in accordance with claim 10, wherein said suction device comprises one of an interior suction box and an exterior suction box.

13. The machine in accordance with claim 4, further comprising an additional jet impingement dryer, wherein said jet impingement dryers are arranged to act on a same side of the fibrous material web.

14. The machine in accordance with claim 4, further comprising an additional jet impingement dryer, wherein said jet impingement dyers are arranged to act on different sides of the fibrous material web.

15. The machine in accordance with claim 4, wherein said jet impingement dryer comprises at least one dryer hood.

16. The machine in accordance with claim 1 wherein the transfer of the fibrous material web to the dying section takes place in the area of a take-up suction roll.

17. The machine in accordance with claim 1, further comprising a straight or slightly curved guide path formed between a transfer point of the fibrous material web from said lower transfer belt and said high-performance dying device.

18. The machine in accordance with claim 17, wherein said straight or slightly curved guide path comprises at least one of a jet impingement drying device and a transfer foil line to dry the fibrous material web prior to said high-performance drying device.

19. A machine for producing a fibrous material web comprising:

a wire section;

a press section arranged downstream of said wire section and comprising first and second extended nip shoe presses separated in the web travel direction;

a drying section arranged downstream of said wire section and said press section and comprising at least one high-performance drying device and at least one open web draw;

an upper felt and a lower transfer belt arranged to guide the fibrous material web through said second extended nip shoe press; and said lower transfer belt being structured and arranged to transfer the fibrous material web directly from the second extended nip shoe press to said drying section, wherein the material web is guided in a closed draw from said wire section, through said press section, and to said open web draw in said drying section.

20. The machine of claim 19, wherein the at least one high-performance drying device is positioned before said open web draw.

21. The machine of claim 19, wherein a lower wire of the drying section is structured and arranged to transfer the fibrous material web to the at least one high-performance drying device.

22. The machine of claim 21, wherein said lower transfer bolt is structured and arranged to transfer the fibrous material web from the second shoe press to an upper wire of said drying section.

23. A machine for producing a fibrous material web comprising:

a wire section;

a press section arranged downstream of said wire section and comprising first and second extended nip shoe presses separated in the web travel direction;

a drying section arranged downstream of said wire section and said press section and comprising at least one high-performance drying device and at least one open web draw;

an upper felt and a lower transfer belt arranged to guide the fibrous material web through said second shoe press; and said lower transfer belt being structured and arranged to transfer the fibrous material web from the second shoe press to an upper wire of said drying section, wherein the material web is guided in a closed draw from said wire section, through said press section, and to said open web draw in said drying section.

24. The machine of claim 23, wherein the at least one high-performance drying device is positioned before said open web draw.

25. The machine of claim 23, wherein a lower wire of the drying section is structured and arranged to transfer the fibrous material web to the at least one high-performance drying device.

* * * * *